US011605900B2

(12) United States Patent
Kim et al.

(10) Patent No.: US 11,605,900 B2
(45) Date of Patent: Mar. 14, 2023

(54) ANTENNA STRUCTURE WITH DIELECTRIC LENS AND TRIANGULAR ELECTRODES

(71) Applicant: ELECTRONICS AND TELECOMMUNICATIONS RESEARCH INSTITUTE, Daejeon (KR)

(72) Inventors: Dong-Young Kim, Daejeon (KR); Mugeon Kim, Daejeon (KR); Kyung Hyun Park, Daejeon (KR); Dong Woo Park, Daejeon (KR); Eui Su Lee, Daejeon (KR); Il Min Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/528,033

(22) Filed: Nov. 16, 2021

(65) Prior Publication Data

US 2022/0158355 A1 May 19, 2022

(30) Foreign Application Priority Data

Nov. 18, 2020 (KR) ..... 10-2020-0154394
Nov. 2, 2021 (KR) ..... 10-2021-0148685

(51) Int. Cl.
*H01Q 19/06* (2006.01)
*H01Q 15/02* (2006.01)
(Continued)

(52) U.S. Cl.
CPC ..... *H01Q 19/06* (2013.01); *H01Q 1/2283* (2013.01); *H01Q 3/46* (2013.01); *H01Q 9/285* (2013.01); *H01Q 15/02* (2013.01); *H01Q 15/08* (2013.01)

(58) Field of Classification Search
CPC ..... H01Q 19/06; H01Q 1/2283; H01Q 3/46; H01Q 15/02; H01Q 15/08; H01Q 9/285
See application file for complete search history.

(56) References Cited

U.S. PATENT DOCUMENTS 10,978,813 B2 4/2021 Yang et al.
2005/0215031 A1* 9/2005 Ouchi ..... G01J 3/0256 438/455

(Continued)

FOREIGN PATENT DOCUMENTS

KR 20050075966 A 7/2005
KR 20120036745 A 4/2012

(Continued)

OTHER PUBLICATIONS

C. Apriono et al., "High-Performance Radiation Design of a Planar Bow-Tie Antenna Combined With a Dielectric Lens and Cascaded Matching Layers at Terahertz Frequencies", International Journal of Technology, Apr. 2018, 3: 589-601.

*Primary Examiner* — Andrea Lindgren Baltzell
*Assistant Examiner* — Yonchan J Kim
(74) *Attorney, Agent, or Firm* — Rabin & Berdo, P.C.

(57) ABSTRACT

An antenna structure includes a dielectric lens, an antenna substrate on the dielectric lens, and antenna electrodes on the antenna substrate. Each of the antenna electrodes may include a wire electrode and an empty plane having a triangular shape defined by the wire electrode. The antenna structure can reduce periodic reflection of a high frequency signal, suppress a periodic gain reduction phenomenon, and provide flat gain characteristics in a wide frequency band.

8 Claims, 5 Drawing Sheets

(51) Int. Cl.

| | |
|---|---|
| ***H01Q 15/08*** | (2006.01) |
| ***H01Q 9/28*** | (2006.01) |
| ***H01Q 1/22*** | (2006.01) |
| ***H01Q 3/46*** | (2006.01) |

(56) References Cited

U.S. PATENT DOCUMENTS

| | | | | |
|---|---|---|---|---|
| 2012/0112230 | A1* | 5/2012 | Jun | H01Q 19/062 438/46 |
| 2012/0153161 | A1 | 6/2012 | Han et al. | |
| 2015/0207233 | A1 | 7/2015 | Kim et al. | |
| 2017/0063351 | A1* | 3/2017 | Kurokawa | G06N 3/049 |
| 2020/0153101 | A1 | 5/2020 | Petros | |
| 2020/0264048 | A1* | 8/2020 | Jarrahi | H01L 31/09 |
| 2021/0057594 | A1* | 2/2021 | Nguyen | H01L 31/0392 |

FOREIGN PATENT DOCUMENTS

| | | | |
|---|---|---|---|
| KR | 20150087595 | A | 7/2015 |
| KR | 1020190117689 | A | 10/2019 |

* cited by examiner

ANTENNA STRUCTURE WITH DIELECTRIC LENS AND TRIANGULAR ELECTRODES

CROSS-REFERENCE TO RELATED APPLICATIONS

This U.S. non-provisional patent application claims priority under 35 U.S.C. § 119 of Korean Patent Application Nos. 10-2020-0154394, filed on Nov. 18, 2020, and 10-2021-0148685, filed on Nov. 2, 2021, the entire contents of which are hereby incorporated by reference.

BACKGROUND

The present disclosure herein relates to an antenna, and more particularly, to a dielectric lens coupling-type antenna structure.

Recently, as data traffic of communication increases rapidly, there is a serious shortage of frequency resources used in communication. In order to expand these frequency resources for communication, commercialization of utilizing frequencies in the millimeter wave band has progressed in recent 5G mobile communications, and research for using unused frequency bands, i.e., terahertz bands for communication has been conducted.

SUMMARY

The present disclosure provides an antenna structure which reduces periodic reflection of a high frequency signal, suppresses periodic gain reduction phenomenon, and has flat gain characteristics in a wide frequency band.

An embodiment of the inventive concept provides an antenna structure. The structure includes: a dielectric lens; an antenna substrate on the dielectric lens; and antenna electrodes on the antenna substrate. Here, each of the antenna electrodes may include: a wire electrode; and an empty plane having a triangular shape defined by the wire electrode.

In an embodiment, the dielectric lens may include crystalline silicon.

In an embodiment, the antenna substrate may include a III-V group semiconductor.

In an embodiment, the wire electrode may include gold.

In an embodiment, each of the antenna electrodes may further include an island electrode which is provided within the empty plane and separated from the wire electrode.

In an embodiment, the island electrode may have a diameter of about 1 nm to about 10 nm.

In an embodiment, a width of the wire electrode may be less than about 20 μm.

In an embodiment, the width of the wire electrode may be about 10 μm.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Figure 1:
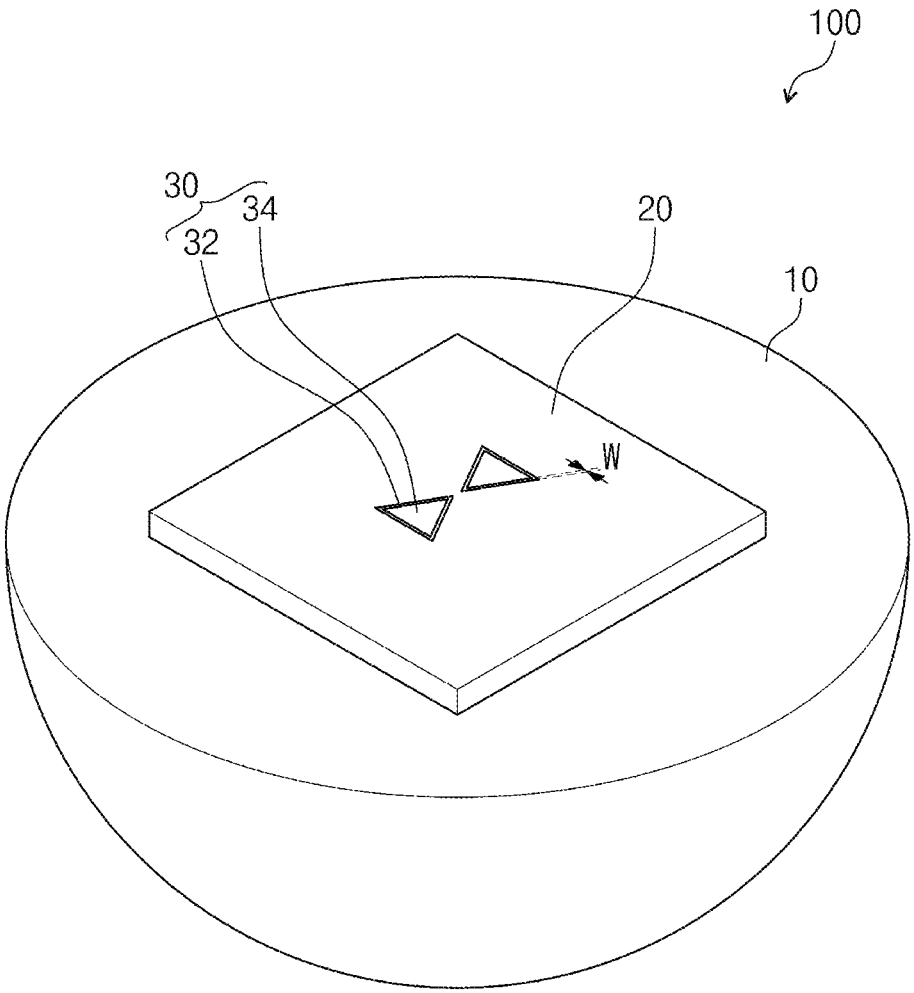
FIG. 1 is a perspective view showing one example of an antenna structure according to the inventive concept.

Hereinafter, embodiments of the inventive concept will be described in detail with reference to the accompanying drawings. Advantages and features of the present disclosure, and implementation methods thereof will be clarified through following embodiments described in detail with reference to the accompanying drawings. The present disclosure may, however, be embodied in different forms and should not be construed as limited to the embodiments set forth herein. Rather, these embodiments are provided so that this disclosure will be thorough and complete, and will fully convey the concept according to the inventive concept to those skilled in the art. Further, the present disclosure is only defined by scopes of claims. Like reference numerals refer to like elements throughout.

The terms used in this specification are used only for explaining embodiments while not limiting the present disclosure. In this specification, the singular forms include the plural forms as well, unless the context clearly indicates otherwise. The meaning of 'comprises' and/or 'comprising' used in the specification does not exclude the presence or addition of one or more components, steps, operations, and/or elements other than the mentioned components, steps, operations, and/or devices. Also, in the specification, a lens, an empty plane, a wire electrode, and an antenna may be understood as having meanings mainly used in the field of communication. Since preferred embodiments are provided below, the order of the reference numerals given in the description is not limited thereto.

FIG. 1 shows one example of an antenna structure 100 according to the inventive concept.

Referring to FIG. 1, the antenna structure 100 according to the inventive concept may be a bow tie antenna structure. According to the inventive concept, the antenna structure 100 may include a dielectric lens 10, an antenna substrate 20, and antenna electrodes 30.

The dielectric lens 10 may support the antenna substrate 20 and the antenna electrodes 30. The dielectric lens 10 may have a hemispherical shape. The bottom surface of the dielectric lens 10 may be rounded, and the top surface of the dielectric lens 10 may be flat. The dielectric lens 10 may include crystalline silicon. Also, the dielectric lens 10 may include silicon oxide or silicon nitride, but the embodiment of the inventive concept is not limited thereto.

The antenna substrate 20 may be provided at the center of the dielectric lens 10. The antenna substrate 20 may have an area smaller than that of the dielectric lens 10. The antenna substrate 20 may have a hexahedral shape. The antenna substrate 20 may have a square shape in a plan view. The antenna substrate 20 may include a III-V group semiconductor. The antenna substrate 20 may include gallium arsenide (GaAs) or indium phosphide (InP), but the embodiment of the inventive concept is not limited thereto.

The antenna electrodes 30 may be provided at the center of the antenna substrate 20. The antenna electrodes 30 may be bow tie antenna electrodes. The number of antenna electrodes 30 may be 2 to N. N may be a natural number.

According to the inventive concept, each of the antenna electrodes 30 may include a wire electrode 32 and an empty plane 34.

The wire electrode 32 may correspond to sides of the triangle. The wire electrode 32 may include gold (Au). The wire electrode 32 may have a width W less than about 20 μm.

The empty plane 34 may be provided within the wire electrode 32. The empty plane 34 may have a triangular shape defined by the wire electrode 32. The triangle may be an isosceles triangle, but the embodiment of the inventive concept is not limited thereto. The empty plane 34 may expose the antenna substrate 20 within the wire electrode 32 in a triangular shape. The empty plane 34 may reduce areas of the antenna electrodes 30 and minimize the reflection of a high frequency signal (radio frequency signal).

Although not illustrated in FIG. 1, a photomixer may be provided on the antenna electrodes 30. The photomixer may transmit a high frequency signal to the antenna electrodes 30. The high frequency signal may include terahertz waves or millimeter waves. Also, the high frequency signal may include an optical signal. On the other hand, the photomixer may receive the high frequency signal from the antenna electrodes 30, but the embodiment of the inventive concept is not limited thereto.

When the photomixer transmits the high frequency signal through the antenna electrodes 30, the high frequency signal may be discharged to the atmospheric air through the antenna substrate 20 and the dielectric lens 10. The high frequency signal may be reflected from the boundary between the dielectric lens 10 and the air. Also, the high frequency signal is re-reflected from metal of the antenna electrodes 30 and may degrade the antenna structure 100. That is, the internal reflection of the high frequency signal may increase in proportion to the surface areas of the antenna electrodes 30.

The wire electrode 32 and the empty plane 34 may reduce the surface areas of the antenna electrodes 30 and minimize the reflection of the high frequency signal. Thus, the antenna structure 100 according to the inventive concept may use the wire electrodes 32 and the empty planes 34, thus reducing the periodic reflection of the high frequency signal and suppressing the periodic gain reduction phenomenon.

Figure 2:
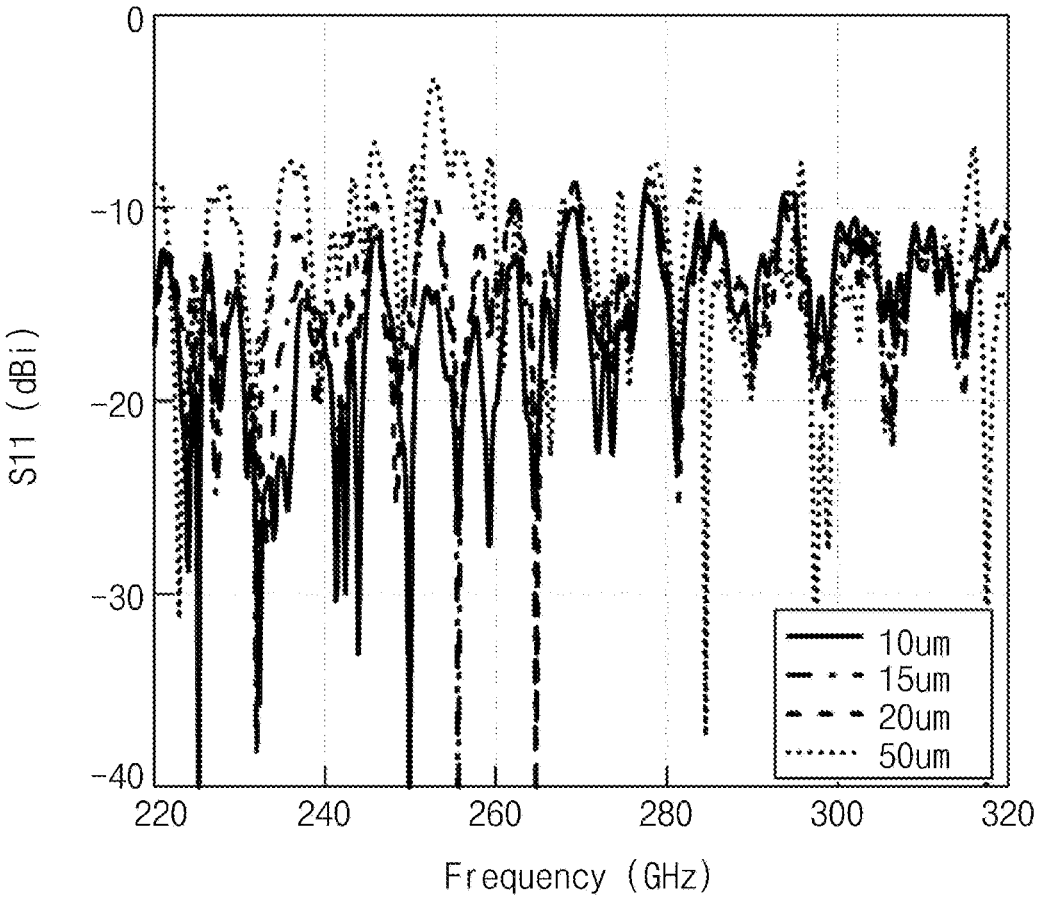
FIG. 2 is a simulation result showing an S-parameter according to a width of a wire electrode of FIG. 1.

FIG. 2 shows an S-parameter according to the width W of the wire electrode 32 of FIG. 1. Here, the horizontal axis may be a frequency of the high frequency signal, and the vertical axis may be the S-parameter.

Referring to FIG. 2, as the width W of the wire electrode 32 is reduced, the S-parameter may be reduced. The wire electrode 32 having the width W of about 10 μm and about 15 μm may have favorable S-parameters of about −10 dB or lower. The wire electrode 32 having the width W of about 20 μm and about 50 μm may have unfavorable S-parameters of about −10 dB or higher. When the width W of the wire electrode 32 is reduced, the periodic reflection of the high frequency signal may be reduced.

Figure 3:
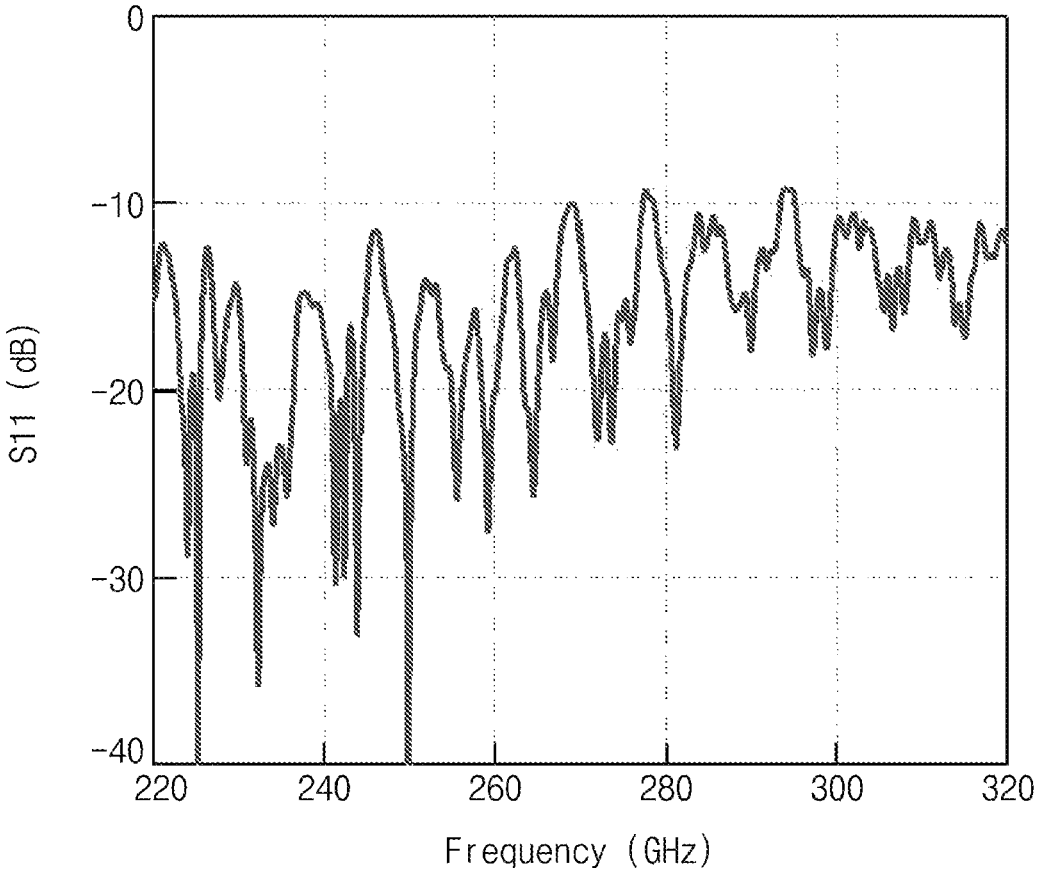
FIG. 3 is a simulation result showing an S-parameter of a wire electrode of FIG. 2 having a width W of about 10 μm.

FIG. 3 shows an S-parameter of the wire electrode 32 of FIG. 2 having the width W of about 10 μm.

Referring to FIG. 3, the wire electrode 32 having the width W of about 10 μm may exhibit an excellent S-parameter of about −10 dB or lower.

Figure 4:
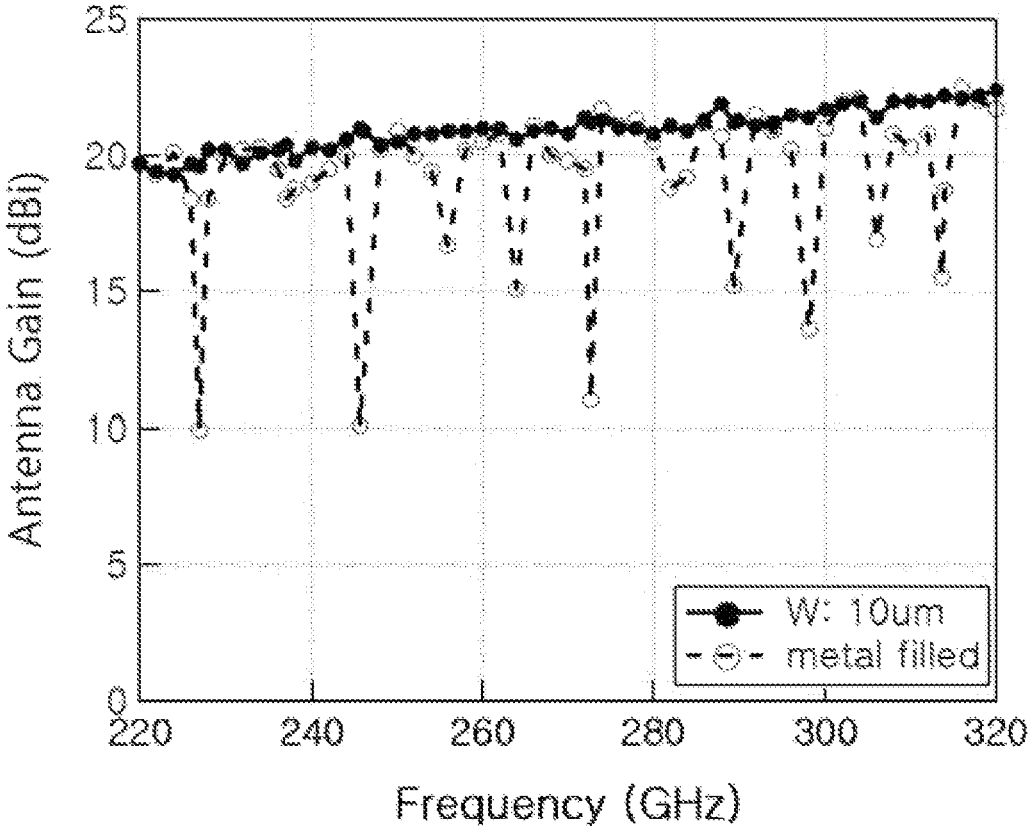
FIG. 4 is a simulation result showing an antenna gain according to a frequency of a high frequency signal.

FIG. 4 shows an antenna gain according to a frequency of a high frequency signal.

Referring to FIG. 4, the wire electrode 32 having the width W of about 10 μm may obtain a stable antenna gain of about 20 dBi or higher. The antenna gain may be nearly flat. However, a general bow-tie antenna with filled metal plate may have a periodic gain reduction with operating frequencies.

Thus, the antenna structure 100 according to the inventive concept may reduce the periodic reflection of the high frequency signal, suppress the periodic gain reduction phenomenon, and have flat gain characteristics in the wide frequency band by using the wire electrode 32 and the empty plane 34.

Figure 5:
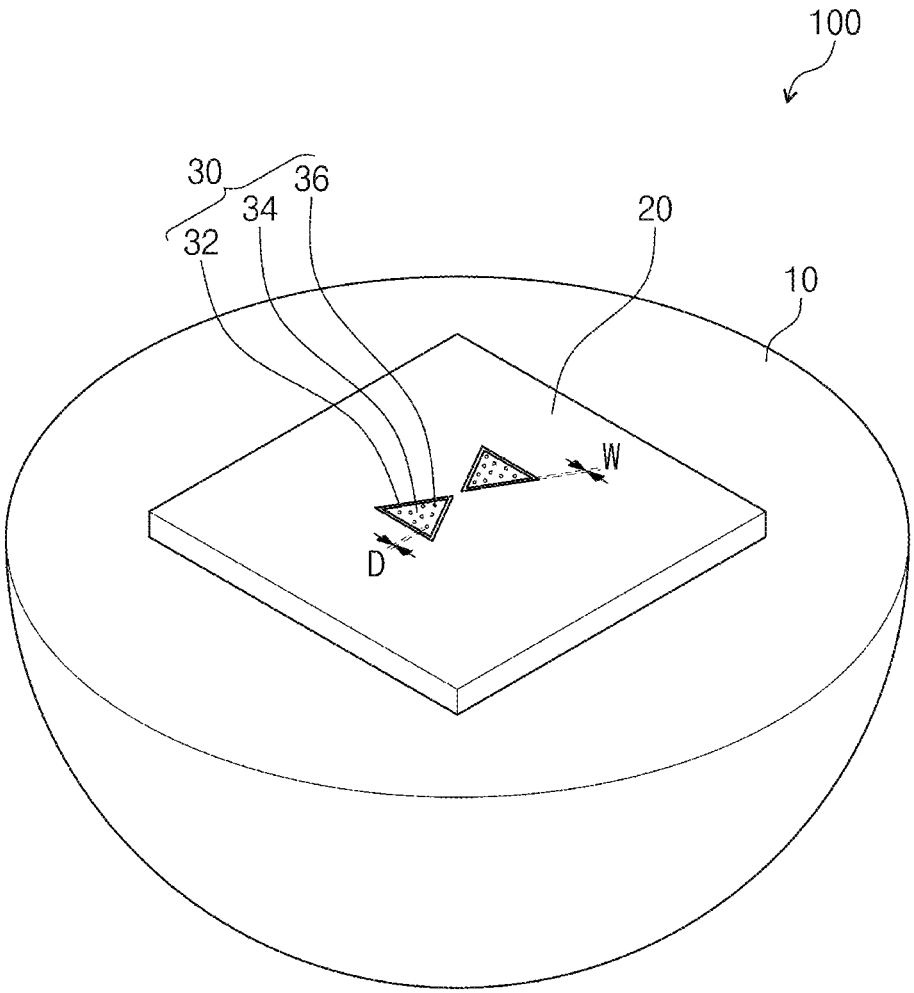
FIG. 5 is a perspective view showing one example of an antenna structure according to the inventive concept.

FIG. 5 shows one example of an antenna structure 100 according to the inventive concept.

Referring to FIG. 5, each of antenna electrodes 30 may further include island electrodes 36 within an empty plane 34.

The island electrodes 36 may be separated from a wire electrode 32. The island electrodes 36 may include the same material as the wire electrode 32. The island electrodes 36 may include gold (Au). Each of the island electrodes 36 may have a diameter D smaller than a width of the wire electrode 32. The diameter D of the island electrodes 36 may be shorter than a wavelength of a high frequency signal. The diameter D of the island electrodes 36 may be about 1 μm or less. For example, the diameter D of the island electrodes 36 may be about 1 nm to about 10 nm.

The island electrodes 36 may increase a contact area with the photomixer irrespective of the internal reflection of the high frequency signal. Thus, the island electrodes 36 may transmit the high frequency signal without increasing effective areas of the antenna electrodes 30.

A dielectric lens 10 and an antenna substrate 20 of the antenna structure 100 may have the same configuration as those in FIG. 1.

As described above, the antenna structure according to the inventive concept may reduce the periodic reflection of the high frequency signal, suppress the periodic gain reduction phenomenon, and have flat gain characteristics in the wide frequency band by using the wire electrodes and the empty planes within the wire electrodes.

The foregoing description is about detailed examples for practicing the inventive concept. The present disclosure may include not only the above-described embodiments but also simply changed or easily modified embodiments. In addition, the present disclosure may also include techniques which may be easily modified and practiced by using the above-described embodiments.

What is claimed is:

1. An antenna structure comprising:

a dielectric lens;

an antenna substrate on the dielectric lens; and antenna electrodes on the antenna substrate, wherein each of the antenna electrodes comprises:

a wire electrode including a closed loop corresponding to a triangle line; and an empty plane having a triangular shape defined by the wire electrode, the empty plane disposed in the closed loop.

2. The antenna structure of claim 1, wherein the dielectric lens comprises crystalline silicon.

3. The antenna structure of claim 1, wherein the antenna substrate comprises a III-V group semiconductor.

4. The antenna structure of claim 1, wherein the wire electrode comprises gold.

5. The antenna structure of claim 1, wherein each of the antenna electrodes further comprises an island electrode which is provided within the empty plane and separated from the wire electrode.

6. The antenna structure of claim 5, wherein the island electrode has a diameter of 1 nm to 10 nm.

7. The antenna structure of claim 1, wherein a width of the wire electrode is less than 20 μm.

8. The antenna structure of claim 7, wherein the width of the wire electrode is 10 μm.

* * * * *